US011203794B2

(12) United States Patent
Liu et al.

(10) Patent No.: US 11,203,794 B2
(45) Date of Patent: Dec. 21, 2021

(54) METHOD FOR MANUFACTURING BAINITE HIGH-STRENGTH SEAMLESS STEEL TUBE, AND BAINITE HIGH-STRENGTH SEAMLESS STEEL TUBE

(71) Applicant: BAOSHAN IRON & STEEL CO., LTD., Shanghai (CN)

(72) Inventors: Yaoheng Liu, Shanghai (CN); Zhonghua Zhang, Shanghai (CN); Xiaobo Wang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 291 days.

(21) Appl. No.: 15/762,810

(22) PCT Filed: Sep. 21, 2016

(86) PCT No.: PCT/CN2016/099562
§ 371 (c)(1),
(2) Date: Mar. 23, 2018

(87) PCT Pub. No.: WO2017/050228
PCT Pub. Date: Mar. 30, 2017

(65) Prior Publication Data

US 2018/0282833 A1 Oct. 4, 2018

(30) Foreign Application Priority Data

Sep. 24, 2015 (CN) ..... 201510615737.9
Apr. 26, 2016 (CN) ..... 201610265674.3
Aug. 30, 2016 (CN) ..... 201610772365.5

(51) Int. Cl.

| | |
|---|---|
| ***C21D 9/08*** | (2006.01) |
| ***C22C 38/04*** | (2006.01) |
| ***C22C 38/08*** | (2006.01) |
| ***C21D 11/00*** | (2006.01) |
| ***C22C 38/06*** | (2006.01) |
| ***B21B 19/04*** | (2006.01) |
| ***C21D 1/667*** | (2006.01) |
| ***C21D 1/18*** | (2006.01) |
| ***C21D 6/00*** | (2006.01) |
| ***C22C 38/00*** | (2006.01) |
| ***C22C 38/02*** | (2006.01) |
| ***C22C 38/12*** | (2006.01) |
| ***C22C 38/40*** | (2006.01) |
| ***C21D 8/10*** | (2006.01) |

(52) U.S. Cl.

CPC ..... *C21D 9/085* (2013.01); *B21B 19/04* (2013.01); *C21D 1/18* (2013.01); *C21D 1/667* (2013.01); *C21D 6/005* (2013.01); *C21D 6/008* (2013.01); *C21D 9/08* (2013.01); *C21D 11/005* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/40* (2013.01); *C21D 8/10* (2013.01); *C21D 8/105* (2013.01); *C21D 2211/002* (2013.01); *C21D 2211/003* (2013.01); *C21D 2211/005* (2013.01); *C21D 2211/008* (2013.01); *C21D 2211/009* (2013.01)

(58) Field of Classification Search

CPC . C21D 9/08; C21D 9/085; C21D 1/18; C21D 1/667; C21D 6/005; C21D 6/008; C21D 11/005; B21B 9/04; C22C 38/002; C22C 38/02; C22C 38/04; C22C 38/06; C22C 38/08; C22C 38/12; C22C 38/40

USPC ..... 148/547

See application file for complete search history.

(56) References Cited

U.S. PATENT DOCUMENTS

2008/0121318 A1 5/2008 Arai et al.
2012/0267014 A1 10/2012 Hitoshio et al.

FOREIGN PATENT DOCUMENTS

CN 102618791 A 8/2012
CN 104878307 A 9/2015
(Continued)

OTHER PUBLICATIONS

English language machine translation of JP-2014198878-A to Nagao. Generated Jan. 9, 2020. (Year: 2020).*
(Continued)

*Primary Examiner* — Brian D Walck
(74) *Attorney, Agent, or Firm* — Neal, Gerber & Eisenberg LLP

(57) ABSTRACT

A method for manufacturing a bainite high-strength seamless steel tube, comprising the following steps: smelting, manufacturing a billet, heating, perforating, rolling, stretch reducing or sizing to obtain tube, and cooling. In the cooling step, the quenching starting temperature is controlled to be at least 20° C. higher than the Ar3 temperature of the steel grade; the finish cooling temperature is controlled to be within a range between T1 and T2, where T1=519-423 C-30.4Mn, T2=780-270 C-90Mn, and the units of the T1 and the T2 are ° C.; in the formulas, C and Mn respectively represent the mass percents of element C and element Mn of the steel grade, the content of the element C is 0.06-0.2%, and the content of the element Mn is 1-2.5%; the cooling rate is controlled to be 15-80° C./s; and the finished product of the bainite high-strength seamless steel tube is directly obtained after the cooling step. The manufacturing of a bainite high-strength seamless steel tube using the method requires neither the addition of precious alloying elements nor the subsequent heat treatment. Therefore the production costs are low.

6 Claims, No Drawings

(56) References Cited

FOREIGN PATENT DOCUMENTS

| | | | | |
|---|---|---|---|---|
| CN | 105154765 | A | | 12/2015 |
| CN | 105907937 | A | | 8/2016 |
| JP | 08-100214 | | * | 4/1996 |
| JP | 2003013130 | A | | 1/2003 |
| JP | 3503211 | B2 | | 3/2004 |
| JP | 2007031756 | A | | 8/2007 |
| JP | 2014198878 | A | * | 10/2014 |
| JP | 2015193868 | A | | 11/2015 |

OTHER PUBLICATIONS

English language machine translation of JP08-100214 to Fujii et al. Generated Jun. 5, 2020. (Year: 2020).*
Communication under Rule 71(3) Intention to Grant issued for EP Patent Application No. 16848109.1 dated Jan. 21, 2021, 7 pages.
Decision of Refusal issued for JP Patent Application No. 2018-515862 dated Oct. 1, 2019, 4 pages.
Examination Report issued for EP Patent Application No. 16848109.1 dated Apr. 9, 2020, 4 pages.
Extended European Search Report issued for EP Patent Application No. 16848109.1 dated Feb. 5, 2019, 8 pages.
First Office Action issued for CN Patent Application No. 201610772365.5 dated Sep. 20, 2017, 7 pages.
Notification to Grant Patent Right for Invention issued for CN Patent Application No. 201610772365.5 dated Aug. 20, 2018, 2 pages.
Office Action issued for JP Patent Application No. 2018-515862 dated Dec. 7, 2018, 8 pages.
Office Action issued for JP Patent Application No. 2018-515862 dated Mar. 27, 2019, 4 pages.
Second Office Action issued for CN Patent Application No. 201610772365.5 dated Mar. 7, 2018, 5 pages.
Third Office Action issued for CN Patent Application No. 201610772365.5 dated Jun. 29, 2018, 5 pages.

* cited by examiner

METHOD FOR MANUFACTURING BAINITE HIGH-STRENGTH SEAMLESS STEEL TUBE, AND BAINITE HIGH-STRENGTH SEAMLESS STEEL TUBE

CROSS-REFERENCE TO RELATED APPLICATION

This application is a national stage entry pursuant to 35 U.S.C. § 371 of International Application No. PCT/CN2016/099562, filed on Sep. 21, 2016, which claims priority to Chinese Patent Application No. 201510615737.9, filed on Sep. 24, 2015, Chinese Patent Application No. 201610265674.3, filed on Apr. 26, 2016, and Chinese Patent Application No. 201610772365.5, filed on Aug. 30, 2016, the contents of all of which are fully incorporated herein by reference.

TECHNICAL FIELD

The invention relates to a steel tube and manufacturing method therefor, and particularly to a seamless steel tube and manufacturing method therefor.

BACKGROUND

Restricted by product form and manufacturing method of the seamless steel tube, for a long time, the performance of the product can be improved only by adding alloying elements and the process of post-rolling off-line heat treatment. Taking oil well tube as an example, it is required to add more alloying elements (such as N80-1) or carry out off-line heat treatment (such as N80-Q and P110) so as to obtain the seamless steel tube corresponding to level of 555 MPa (80 ksi) or above, which obviously increases the manufacturing cost.

As the common process for hot-rolling steel tube, the tube after rolling is put on the cooling bed for air cooling, and then subjected to reheating as needed and off-line heat treatment (normalizing and quenching & tempering, etc.), which not only causes a waste of residual heat after rolling (the temperature of the steel tube after rolling is usually above 900° C.), but also fails to control the matrix structure in the rolled state and improve the performance by controlling the matrix structure. In addition, when the cooling is poor, coarse crystal grains, mixed crystals, Widmanstatten structure and other adverse matrix structures can be easily formed. These problems are partially inherited during off-line heat treatment, and it is difficult to completely solve.

The Chinese patent document (the publication number: CN103740896A; the publication date: Apr. 23, 2014) entitled "An On-line Quenching Method for A Steel Tube" discloses an on-line quenching method for the steel tube, wherein the steps are as follows:

1) After rolling and sizing the high-temperature steel tube with 970-980° C. is directly transferred to a quenching tank.

2) Rotate the high-temperature steel tube; spray water on the inner wall of the high-temperature steel tube along the extending direction of the high-temperature steel tube, and the speed of the water spraying of the inner wall is 6500-7000 cubic meters per hour; spray water along the tangent line of the outer wall of the high-temperature steel tube in the direction opposite to the rotation direction of the steel tube, and the speed of the water spraying along the outer wall is 4500-5000 cubic meters per hour, and the total time of the water spraying is 10-12 minutes, so that the high-temperature steel tube is submerged in 10-12 seconds. 3) When the high-temperature steel tube is cooled to 250-260° C. discharge the water from the quenching tank and finish the quenching to obtain the quenched steel tube.

Although the above patent has provided a method for quenching a steel tube by utilizing residual heat, since the seamless steel tube has a special sectional shape, compared to plates, its internal stress state is more complicated, so if an online quenching process is used, it is difficult to control its performance stably, and on the other hand, it is likely to cause cracks of the steel tube. Therefore, it is difficult to apply the on-line quenching to the seamless steel tube. The influence of the control of the on-line quenching parameter on the performance of the steel tube is not mentioned in the above patent. In addition, the purpose of the quenching described in the patent is to obtain a martensite-based matrix structure, so that an additional tempering process is also required after the on-line quenching.

DISCLOSURE OF INVENTION

One of the purpose of the invention is to provide a method for manufacturing a bainite high-strength seamless steel tube, wherein the phase transition is controlled by means of on-line controlled cooling, so that a bainite seamless steel tube (yield strength ≥555 MPa. and impact energy of full size sample at 0° C. >50 J) with high strength and toughness, stable performance and no cracking is obtained on the condition of not adding expensive alloying elements and not carrying out the subsequent off-line heat treatment, thereby realizing the need for low-cost production of high-performance seamless steel tube products.

To achieve the above purpose of the invention, the inventor made a research for the manufacturing process of the bainite steel tube, and found that after the thermal deformation of the steel tube, due to the induction effect of deformation to phase transition, on-line rapid cooling was carried out to obtain a finer matrix structure, so that better strength and toughness were obtained; the matrix structure and the final performance of the steel tube could be effectively adjusted by controlling the cooling process parameters including the quenching starting temperature, the cooling temperature, and the finish cooling temperature.

The present invention was completed based on the above recognition. To achieve the above purpose, the invention provides a method for manufacturing a bainite high-strength seamless steel tube, comprising the following steps: smelting, manufacturing a billet, heating, piercing, rolling, stretch reducing or sizing to obtain tube, and cooling; wherein the cooling steps are as follows:

control the quenching starting temperature to meet the following formula: the quenching starting temperature≥the Ar3 temperature of the steel grade +20° C.; the finish cooling temperature is controlled to be within a range between T1 and T2, where T1=519-423 C-30.4Mn, T2=780-270 C-90Mn, and units of T1 and T2 are ° C.; in the formulas, C and Mn respectively represent the mass percents of element C and element Mn of the steel grade, the content of the element C is 0.06-0.2%, and the content of the element Mn is 1-2.5%; the cooling rate is controlled to be 15-80° C./s; and the finished product of the bainite high-strength seamless steel tube is directly obtained after the cooling step.

In the method for manufacturing a bainite high-strength seamless steel tube of the invention, the smelted molten steel can be directly cast into a round billet, and can also be cast into blank followed by forging or rolling into a billet.

To obtain enough strength and ensure that the bainite transformation is as complete as possible, the quenching starting temperature should be maintained at the Ar3 temperature (temperature of austenite phase transition) of the steel grade plus 20° C. or more, and the Ar3 temperature of the steel grade is known for the person skilled in the art or can be obtained from the prior art, including checking manuals or using thermal simulation experiments.

To obtain enough strength and toughness, it is necessary to ensure a sufficiently complete bainite transformation and refinement of the grain structure. The increase of the cooling rate favors the bainite transformation and also contributes to the increase of super-cooling degree of austenite, increasing the number of nucleation, refining the bainite matrix structure, and therefore the cooling rate is required to be controlled to increase the super-cooling degree of the deformed austenite. According to the technical solution of the invention, the average cooling rate from the quenching starting temperature to the finish cooling temperature needs to be ≥15° C./s, and at the same time, the average cooling rate needs to be controlled to be no more than 80° C./s to prevent the steel tube from cracking due to the stress concentration problem in the circular section of the steel tube; if the finish cooling temperature is too low, matrix structure of martensite will be formed to affect the toughness, and if the finish cooling temperature is too high, the required matrix structure of bainite will not be obtained. So this technical solution proposes that the finish cooling temperature is controlled to be within a range between T1 and T2 to obtain the required matrix structure of bainite and properties, where T1=519-423 C-30.4Mn, T2=780-270 C-90Mn, and units of T1 and T2 are ° C.; in the formulas, C and Mn respectively represent the mass percents of element C and element Mn of the steel grade, that is to say, if the content of the element C is controlled to be 0.06%, the value substituted in the formula is 0.06 instead of 0.0006 (that is, 0.06%).

Further, in the method for manufacturing a bainite high-strength seamless steel tube, wherein the cooling steps are taken by means of water cooling.

Further, in the method for manufacturing a bainite high-strength seamless steel tube, wherein in the cooling steps, water is sprayed on the outer wall of the tube for cooling.

Further, in the method for manufacturing a bainite high-strength seamless steel tube, wherein in the cooling steps, the tube is placed in the sink for cooling.

In the method for manufacturing a bainite high-strength seamless steel tube of the invention, according to the requirement of the production line, the cooling mode can be water cooling, including spraying water on the outer wall of the tube for cooling, or placing the tube in the sink for cooling.

Further, in the method for manufacturing a bainite high-strength seamless steel tube, wherein in the heating steps, the billet is heated to 1150-1300° C. and maintained for 1-4 hours.

In the method for manufacturing a bainite high-strength seamless steel tube of the invention, according to the conditions of different hot rolling mills, the heating temperature is usually not less than 1150° C. to ensure sufficient deformability of the billet, and meanwhile the heating temperature does not exceed 1300° C. to prevent the billet from being over burnt.

Further, in the method for manufacturing a bainite high-strength seamless steel tube, wherein the bainite high-strength seamless steel tube comprises following chemical elements by mass: C, 0.06~0.2%; Si, 0.1~0.6%; Mn, 1~2.5%; Al, 0.01~0.1%; S≤0.005%; P≤0.02%; O≤0.01%; and the balance being Fe and other unavoidable impurities.

The main design principles of each chemical element in the bainite high-strength seamless steel tube are as follows:

C: carbon is an important element for ensuring strength and hardenability, and according to the invention, when the content of carbon is less than 0.06%, the strength of the steel tube is difficult to guarantee, and it is difficult to avoid the precipitation of pro-eutectoid ferrite when the content of carbon is low, affecting the toughness of the steel tube. Due to the double effects of deformation stress and phase transition stress on the on-line cooling material, cracks can be more easily generated compared with the off-line heat treatment; test shows that quenching cracks can be reduced obviously when the content of carbon is controlled to be no more than 0.2%; therefore the content of carbon of the bainite high-strength seamless steel tube according to the present invention is controlled at 0.06~0.2%.

Si: silicon is an element that is brought by a deoxidizer in the steel, when its content exceeds 0.6%, the tendency for cold-brittleness of the steel will increase significantly. For this reason, it is necessary to limit the content of silicon to 0.6% or less. In addition, the content of silicon should be 0.1% or above so as to ensure the deoxidization effect; therefore the content of silicon of the bainite high-strength seamless steel tube according to the present invention is controlled at 0.1~0.6%.

Mn: manganese has beneficial effects such as expanding the austenite phase region, increasing hardenability, and refining crystal grains. However, manganese tends to segregate during solidification, resulting in a marked banded matrix structure in the final product. There are obvious differences in the hardness and precipitation phase between the ribbon-like matrix structure and the matrix, which will affect the toughness of the steel tube. Therefore, it is necessary to limit the content of manganese to 2.5% or less. In addition, in order to ensure the uniformity and hardenability of the matrix structure of the steel after cooling, it is necessary to keep the content of manganese at 1% or more; therefore, the content of manganese of the bainite high-strength seamless steel tube according to the present invention is controlled at 1~2.5%.

Aluminum is an element necessary for steel deoxidation. However, if the content of aluminum exceeds 0.1%, the casting process and the like are adversely affected. Therefore, it is necessary to limit the content of aluminum to 0.1% or less, and more preferably 0.05% or less.

S: sulfur is a harmful element in steel, and its presence has adverse effects on the hot workability and toughness of steel. Therefore, it is necessary to limit the content of sulfur of the bainite high-strength seamless steel tube according to the present invention to 0.005% or less.

P: phosphorus is a harmful element in steel, and its presence has adverse effects on the corrosion resistance and toughness of steel. Therefore, it is necessary to limit the content of phosphorus of the bainite high-strength seamless steel tube according to the present invention to 0.02% or less.

O: oxygen is an element that decreases toughness. Therefore to ensure that the product has sufficient toughness, the content of oxygen of the bainite high-strength seamless steel tube according to the present invention is 0.01% or less.

Further, in the bainite high-strength seamless steel tube, the mass percentages of the element C and the element Mn satisfy: C+Mn/6≥0.38.

The main principle of the present invention is to use the control of cooling path to obtain the bainite structure so as to obtain sufficient toughness. However, if the alloying elements in the steel are lower than a certain degree, on the one hand, the effect of solid solution strengthening is limited, and on the other hand, the strength of the obtained bainite structure also decreases, making it difficult to obtain high strength of 555 MPa or more. According to the study of the present invention, the main alloying elements C. Mn need to satisfy: C+Mn/6≥0.38.

The bainite high-strength seamless steel tube manufactured by the method of the invention has a yield strength >555 MPa, and an impact energy (full size test piece) at 0° C. >50 J.

Another purpose of the present invention is to provide a bainite high-strength seamless steel tube manufactured by the method of the present invention, which has a high strength of yield strength ≥555 MPa, and a high toughness of an impact energy (full size test piece) at 0° C. >50 J without adding expensive alloying elements.

DETAILED DESCRIPTION

The method for manufacturing a bainite high-strength seamless steel tube and the bainite high-strength seamless steel tube manufactured by the method are now explained and described accompanying the specific embodiments as follows, and the explanation and the description shall not be deemed to limit the technical scheme of the invention.

Example A1-A8 and Comparative Example B1-B7

Bainite high-strength seamless steel tubes in Example A1-A8 and Comparative Example B1-B5 were manufactured according to the following steps:

(1) smelting, and controlling steel composition as shown in Table 1 (it should be noted that the steel component of the smelting step is the same as that of the bainite high-strength seamless steel tube products);

(2) manufacturing a billet: the smelted molten steel was directly cast into a round billet, or cast into blank followed by forging or rolling into a round billet;

(3) heating: the round billet was heated to 1150-1300° C. and maintained for 1-4 hours;

(4) piercing;

(5) rolling;

(6) stretch reducing or sizing to obtain tube;

(7) cooling: the quenching starting temperature was controlled to be at least 20° C. higher than the Ar3 temperature of the steel grade; the finish cooling temperature was controlled to be within a range between T1 and T2, where T1=519-423 C %-30.4Mn %, T2=780-270 C %-90Mn %, and the units of the T1 and the T2 were ° C.; in the formulas, C and Mn respectively represented the mass percents of element C and element Mn of the steel grade, the content of the element C was 0.06-0.2%, and the content of the element Mn was 1-2.5%; the cooling rate was controlled to be 15-80° C./s; and the finished product of the bainite high-strength seamless steel tube was directly obtained after the cooling step (see Table 2 for the specific process parameters of each embodiment and comparative example).

Table 1 lists the mass percentages of chemical elements of Example A1-A8 and Comparative Example B1-B7.

TABLE 1

(by wt %, the balance is Fe and other impurities except O, P and S)

| Classifications | No. | Compositions ( wt %) C | Si | Mn | P | S | O | Al | C + Mn/6 |
|---|---|---|---|---|---|---|---|---|---|
| Examples | A1 | 0.1 | 0.17 | 1.82 | 0.012 | 0.003 | 0.005 | 0.02 | 0.40 |
| | A2 | 0.18 | 0.36 | 1.25 | 0.018 | 0.003 | 0.004 | 0.015 | 0.39 |
| | A3 | 0.09 | 0.25 | 1.96 | 0.016 | 0.001 | 0.008 | 0.03 | 0.42 |
| | A4 | 0.18 | 0.38 | 1.78 | 0.012 | 0.002 | 0.003 | 0.07 | 0.48 |
| | A5 | 0.07 | 0.25 | 2.14 | 0.018 | 0.002 | 0.004 | 0.04 | 0.43 |
| | A6 | 0.15 | 0.58 | 1.65 | 0.016 | 0.004 | 0.005 | 0.02 | 0.43 |
| | A7 | 0.16 | 0.28 | 1.31 | 0.012 | 0.002 | 0.003 | 0.035 | 0.38 |
| | A8 | 0.14 | 0.35 | 1.49 | 0.018 | 0.002 | 0.002 | 0.03 | 0.39 |
| Comparative Examples | B1 | 0.13 | 0.18 | 1.73 | ***0.025*** | ***0.009*** | 0.008 | 0.02 | 0.42 |
| | B2 | ***0.24*** | 0.18 | 1.23 | 0.015 | 0.004 | 0.005 | 0.08 | 0.45 |
| | B3 | 0.15 | 0.17 | 1.17 | 0.01 | 0.002 | 0.002 | 0.02 | ***0.35*** |
| | B4 | 0.14 | 0.35 | 1.49 | 0.018 | 0.002 | 0.002 | 0.033 | 0.39 |
| | B5 | 0.14 | 0.35 | 1.49 | 0.018 | 0.002 | 0.002 | 0.04 | 0.39 |
| | B6 | 0.14 | 0.35 | 1.49 | 0.018 | 0.002 | 0.002 | 0.03 | 0.39 |
| | B7 | 0.14 | 0.35 | 1.49 | 0.018 | 0.002 | 0.002 | 0.05 | 0.39 |

It can be seen from Table 1 that the contents of P and S in Comparative Example B1 are higher than the preferred range of the present invention; the content of C in Comparative Example B2 is higher than the preferred range of the present invention; the value of C+Mn/6 in Comparative Example B3 does not match the preferred range of the present invention.

Table 2 lists the specific parameters of the manufacturing methods of Example A1-A8 and Comparative Example B1-B7.

TABLE 2

| | | Heating | | Cooling | | | | | | |
|---|---|---|---|---|---|---|---|---|---|---|
| Classifications | No. | Heating temperature/ ° C. | Holding time/h | Cooling mode[note] | Ar3/ ° C. | Quenching starting temperature/° C. | Finish cooling temperature/° C. | T1 (T1 = 519-423° C. %-30.4 Mn %)/° C. | T2 (T2 = 780-270° C. %-90 Mn %)/° C. | Average cooling rate/ ° C./s |
| Examples | A1 | 1260 | 2 | Immersing | 814 | 860 | 480 | 421.37 | 589.2 | 45 |
| | A2 | 1240 | 2 | Immersing | 816 | 910 | 460 | 404.86 | 618.9 | 32 |
| | A3 | 1200 | 2 | Spraying | 817 | 960 | 500 | 421.35 | 579.3 | 23 |
| | A4 | 1300 | 2 | Immersing | 809 | 950 | 540 | 388.75 | 571.2 | 38 |
| | A5 | 1190 | 2 | Immersing | 818 | 840 | 520 | 424.33 | 568.5 | 40 |
| | A6 | 1260 | 2 | Spraying | 825 | 910 | 470 | 405.39 | 591 | 29 |
| | A7 | 1280 | 2 | Spraying | 815 | 860 | 500 | 411.50 | 618.9 | 27 |
| | A8 | 1270 | 2 | Spraying | 819 | 850 | 600 | 414.48 | 608.1 | 28 |

TABLE 2-continued

| Classifications | No. | Heating: Heating temperature/° C. | Heating: Holding time/h | Cooling: Cooling mode[note] | Cooling: Ar3/° C. | Cooling: Quenching starting temperature/° C. | Cooling: Finish cooling temperature/° C. | Cooling: T1 (T1 = 519-423° C. %-30.4 Mn %)/° C. | Cooling: T2 (T2 = 780-270° C. %-90 Mn %)/° C. | Cooling: Average cooling rate/° C./s |
|---|---|---|---|---|---|---|---|---|---|---|
| Comparative Examples | B1 | 1250 | 2 | Immersing | 810 | 920 | 510 | 411.42 | 589.2 | 34 |
| | B2 | 1250 | 2 | Immersing | 798 | 910 | 500 | 380.09 | 604.5 | 33 |
| | B3 | 1260 | 2 | Spraying | 814 | 870 | 490 | 419.98 | 634.2 | 28 |
| | B4 | 1130 | 2 | Spraying | 819 | ***640*** | 490 | 414.48 | 608.1 | 30 |
| | B5 | 1290 | 2 | Spraying | 819 | 890 | 500 | 414.48 | 608.1 | ***11*** |
| | B6 | 1290 | 2 | Spraying | 819 | 890 | ***700*** | 414.48 | 608.1 | 24 |
| | B7 | 1290 | 2 | Spraying | 819 | 890 | ***220*** | 414.48 | 608.1 | 25 |

Note:
cooling mode—spraying (spraying on the outer wall for cooling), immersing (immersing the tube into the sink for cooling)

It can further be seen from Table 2 that the quenching starting temperature of Comparative Example B4 is lower than the range defined by the present invention, and the cooling rate of Comparative Example B5 is lower than the range defined by the present invention. The finish cooling temperature of Comparative Example B6 is higher than the range defined by the present invention and the finish cooling temperature of Comparative Example B7 is lower than the range defined by the present invention.

Table 3 shows the measured parameters of mechanical properties of the seamless steel tubes of Example A1-A8 and Comparative Example B1-B7 placed on the cooling bed and air cooled to room temperature.

TABLE 3

| Classifications | No. | Yield strength Rp0.2/MPa | Impact energy/J (full size test piece, 0° C. ) |
|---|---|---|---|
| Examples | A1 | 588 | 148 |
| | A2 | 725 | 127 |
| | A3 | 590 | 224 |
| | A4 | 672 | 93 |
| | A5 | 608 | 170 |
| | A6 | 696 | 109 |
| | A7 | 598 | 121 |
| | A8 | 614 | 107 |
| Comparative Examples | B1 | 705 | ***28*** |
| | B2 | 660 | ***31*** |
| | B3 | ***496*** | 68 |
| | B4 | ***442*** | 154 |
| | B5 | ***394*** | 165 |
| | B6 | ***401*** | 124 |
| | B7 | 815 | ***36*** |

In Table 3 above, the performance test results are from the following tests:

(1) Strength test: the prepared seamless steel tube is processed into an API arc sample, and the average value is obtained after the inspection according to the API standard to obtain the yield strength.

(2) Impact toughness test: the prepared seamless steel tube is processed into a standard impact sample with 10*10*55 size and V-notch, which is tested at 0° C.

As can be seen from Table 3, the yield strengths of the seamless steel tubes of Example A1-A8 are all higher than 550 MPa. and the impact energies (full size test piece) at 0° C. are all higher than 50 J, which is superior to the corresponding performances of Comparative Example B1-B7, and those seamless steel tubes have advantages of high strength and high toughness, which can be applied in oil and gas production, mechanical structure and other fields, meeting the corresponding mechanical performance indicators in this field. Meanwhile, the residual heat during the manufacture of seamless steel tubes is fully utilized, and the manufacturing process is convenient, basically not adding alloying elements, and the cost can be controlled in a lower range.

It can also be seen from Table 3 that the impurity elements P and S of Comparative Example B1 exceed the optimized range, reducing the impact toughness of the seamless steel tube; the content of C of Comparative Example B2 is too high, so that the seamless steel tube influenced by both deformation stress and transformation stress during cooling are likely to crack, reducing the impact toughness; C+Mn/6<0.38 in B3 affects hardenability, and the deformation is insufficient, affecting the effect of the deformation inducing phase transition, reducing the yield strength; insufficient quenching starting temperature of Comparative Example B4 leads to the formation of the pro-eutectoid ferrite in the matrix structure, reducing the yield strength; the cooling rate of Comparative Example B5 is too low and it leads to insufficient proportion of martensite in the matrix structure, reducing the yield strength; the finish cooling temperature of Comparative Example B6 is too high to obtain the required bainite, reducing the yield strength; the finish cooling temperature of Comparative Example B7 is too low and it leads to excessive martensite, reducing the impact toughness.

It should be noted that the above examples are only specific embodiments of the invention. Apparently, the invention is not limited to the above embodiments, and there may be many similar variations. A person skilled in the art can directly derive or associate all the variations from the content disclosed by the invention, all of which shall be covered by the protection scope of the invention.

The invention claimed is:

1. A method for manufacturing a bainite seamless steel tube consisting of chemical elements by mass: C, 0.06-0.2%; Si, 0.1-0.6%; Mn, 1-2.5%; Al, 0.01-0.1%; S≤0.005%; P≤0.02%; O≤0.01%, and the balance being Fe and other unavoidable impurities, wherein the mass percentages of the element C and the element Mn satisfy: C+Mn/6≥0.38, the method comprising the following ordered steps:

smelting;

manufacturing a billet;

heating the billet;

piercing, rolling and stretch reducing or sizing to obtain a tube;

cooling the tube, wherein the cooling step comprises a cooling rate of 15-80° C./s and commences once the tube reaches a temperature greater than or equal to the Ar3 temperature of the steel grade +20° C. and ceases once the tube achieves a temperature within a range between T1 and T2, wherein T1=519-423 C-30.4Mn, T2=780-270 C-90Mn, and units of T1 and T2 are ° C. in the formulas, wherein C and Mn respectively represent the mass percent of element C and element Mn of the steel grade;

obtaining a bainite seamless steel tube, wherein the bainite seamless steel tube is directly obtained after the cooling step.

2. The method for manufacturing a bainite seamless steel tube according to claim 1, wherein the cooling step comprises water cooling.

3. The method for manufacturing a bainite seamless steel tube according to claim 2, wherein the water cooling comprises spraying water on the outer wall of the tube for cooling.

4. The method for manufacturing a bainite seamless steel tube according to claim 2, wherein the cooling step comprises placing the tube in a sink for cooling.

5. The method for manufacturing a bainite seamless steel tube according to claim 1, wherein the heating step comprises heating the billet to 1150-1300° C. and maintained for 1-4 hours.

6. The method for manufacturing a bainite seamless steel tube according to claim 1, wherein the bainite seamless steel tube manufactured by said method has a yield strength >555 MPa, and an impact energy (full size test piece) at 0° C. of >50 J.

* * * * *